United States Patent [19]

Gavin et al.

[11] Patent Number: 4,854,520

[45] Date of Patent: Aug. 8, 1989

[54] APPARATUS FOR FORMING CENTER-UNWINDABLE ROLLS OF PERFORATED PLASTIC FILM

[75] Inventors: James R. Gavin, Pittsford; James F. Roeland, Clifton Springs, both of N.Y.

[73] Assignee: Mobil Oil Corporation, New York, N.Y.

[21] Appl. No.: 244,434

[22] Filed: Sep. 14, 1988

Related U.S. Application Data

[60] Division of Ser. No. 83,908, Aug. 6, 1987, Pat. No. 4,771,962, which is a continuation of Ser. No. 808,972, Dec. 16, 1985, abandoned.

[51] Int. Cl.[4] ..... B65H 18/10

[52] U.S. Cl. ..... 242/72 B; 242/74.1; 242/56.9

[58] Field of Search ..... 242/68.5, 72 B, 74, 242/56.9, 74.1, 67.1 R

[56] References Cited

U.S. PATENT DOCUMENTS

| | | | |
|---|---|---|---|
| 2,779,547 | 1/1957 | Roberts et al. | 242/74 |
| 2,916,226 | 12/1959 | McGraw, Jr. | 242/68.5 |
| 3,053,467 | 9/1962 | Gidge | 242/72 |
| 3,297,155 | 1/1967 | Gattenby et al. | 206/59 |
| 3,527,424 | 9/1970 | Goldman | 242/74 |
| 3,552,670 | 1/1971 | Herman | 242/56 |
| 3,743,199 | 7/1973 | Karr et al. | 242/65 |
| 3,840,197 | 10/1974 | Rodach | 242/78.3 |
| 3,863,857 | 2/1975 | Smith | 242/72 B |
| 4,030,681 | 6/1977 | Schott, Jr. | 242/81 |
| 4,327,877 | 5/1982 | Perini | 242/66 |
| 4,391,415 | 7/1983 | Hollier | 242/56.9 |

*Primary Examiner*—David Werner

*Attorney, Agent, or Firm*—Alexander J. McKillop; Charles J. Speciale

[57] ABSTRACT

An apparatus is disclosed for winding strips or tubes of plastic film into center-unwindable rolls having a diameter of at least about 3 inches and for unloading the wound rolls without telescoping thereof. Bare expandable winding shafts are provided which comprise a fixed vacuum leaf and a plurality of movable leaves controlled by an elongated air bladder, the contracted diameter being at least about one-quarter inch less than the expanded diameter. Each leaf also has an outer surface having a selected slipperiness toward the film surface.

9 Claims, 2 Drawing Sheets

APPARATUS FOR FORMING CENTER-UNWINDABLE ROLLS OF PERFORATED PLASTIC FILM

This is a dimensional of copending application Ser. No. 083,908, filed on Aug. 6, 1987, now U.S. Pat. No. 4,771,962, which is a continuation of Ser. No. 808,972 filed Dec. 16, 1985, now abandoned.

BACKGROUND OF THE INVENTION

1. Field of the Invention

This invention relates to methods for continuously winding transversely perforated plastic film into larger-diameter rolls. It further relates to methods for transferring a moving film from a fully wound roll on a first bare winding shaft onto a second bare shaft. It especially relates to methods for enabling large-diameter rolls of perforated plastic film to be unloaded from a bare shaft.

2. Review of the Prior Art

When winding rolls of a plastic film, several problems occur because of the characteristics of the film. Slipperiness of the film is one such characteristic. If the film is in the form of a narrow strip which is folded lengthwise, sealed lengthwise, and gussetted to form a tube, uneven thickness creates difficulties. If the folded, sealed, and gussetted tube is also transversely perforated and sealed, there are further operational problems.

The reason therefor is that transversely perforated plastic film can withstand very little tensional force without being separated. Consequently, in a turret winding operation on a first bare expandable shaft which is disposed at a winding position, a transversely perforated plastic film cannot be wound with sufficient tension to form a compact and rigid finished roll. This difficulty is magnified when the roll of plastic film is a center-unwindable roll having an inner diameter of at least about 3 inches. Further, when a plastic film is in the form of a transversely perforated and flattened tube for separation by a consumer into freezer bags, produce bags, and the like, the relatively loose winding of such a narrow center-unwindable roll is accentuated so that telescoping of the roll easily occurs when a sidewise force is placed thereon, such as when unloading the roll from a shaft on which it has been wound. A means for preventing such telescoping, such as minimizing the sidewise force required for unloading a roll from a shaft, is needed.

It is also difficult to transfer a moving strip or tube of such transversely perforated film from a wound roll to a new shaft upon which the strip of film or tube of film is to be wound because the lay-on roll cannot be applied to the moving strip or tube with sufficient force to bend the strip or tube into adequate contact with the new shaft. Accordingly, a means for effecting such transfer, without premature breakage of the strip or roll, is additionally needed.

U.S. Pat. No. 3,053,467 describes expansible shafts, arbors, or mandrels of the fluid pressure type on which a tubular core of rolls of paper may be supported for winding and unwinding. This shaft has a multiplicity of radially movable and self retractable gripping buttons which are actuated by an inflatable, cylindrical air bag.

Such an expansible shaft is further described in U.S. Pat. No. 3,863,857, wherein elongate leaf members are attached to the ends of the buttons and are radially expanded by inflation of the air bladder. These expansible air shafts are primarily intended for gripping a core of a roll of paper or other web material. After winding is completed, the buttons or leaf members are retracted so that the core can be slid endwise from the winding shaft. If individual rolls are to be wound, such as when winding tubes of transversely perforated film to form rolls that can be separated into plastic bags by a consumer, the core may be furnished with a circumferentially attached strip of expansible adhesive tape in order to facilitate transfer of a continuously moving tube onto a new core.

U.S. Pat. No. 2,779,547 describes a winding mandrel with a suction means, comprising a drum mounted for rotation about the axis of a hollow shaft and provided with a slot which is parallel to the axis of rotation of the shaft and runs substantially the length of the drum and in which is positioned a suction box connected at its center to an external vacuum pump through a rotary seal at an end of the mandrel. An aperture pad of non-porous rubber fits into the suction box and has spaced holes along the length thereof to form suction passages. In operation, a moving paper web is drawn by suction at the holes into frictional anchorage upon the pad.

U.S. Pat. No. 3,552,670 describes a web-winding apparatus of the automatic or continuous type for automatically moving a new "core-carrying" mandrel into the path of the web while it is still being wound on a preceding core-carrying mandrel to complete the winding of that roll. The web is fed in partial wrapping engagement over a bed roll to a core on one of a plurality of rotatably mounted winding mandrels carried in revolution by a rotatable turret past a pickup position where the free leading edge of a web formed by transverse severance of the web is transferred to a core disposed in a successive winding mandrel. A stationary vacuum chamber is formed within the interior of the bed roll and communicates through one end to a source of partial vacuum and peripherally through a plurality of holes in the shell of the bed roll. Where light, relatively impervious web materials are involved, such as sanitary tissues having transverse lines of weakness, the shell has relatively few openings through which a partial vacuum acts on the web. The bed roll has openings in the form of slots having a width of about 0.040 inch and a very short radial distance through which the vacuum must act, so that when a breakage occurs at a line of transverse perforations, the loose end of the web is caught very quickly onto the bed roll.

U.S. Pat. No. 3,743,199 describes a vacuum reel spool for use on a paper machine reel when transferring a very light web to a new reel spool. The reel spool comprises a cylindrical shell having a longitudinal axis of rotation and a plurality of perforations which are formed uniformly on the surface of the shell along substantially the entire face width thereof. The interior of the reel spool is connected to a vacuum source, such as a vacuum pump. During operation, the vacuum produced within the reel spool urges the ballooned portion of the web, that is formed between a previously wound roll and a new reel spool, into the nip between the reel drum and the reel spool so that even especially light webs, such as tissue paper, can be reeled continuously when traveling at speeds as high as 3500 feet per minute.

U.S. Pat. No. 4,030,681 describes a winder for plastic film in the absence of a winding core. The winder features equalized air lubrication of the wound roll throughout its axial removal from the arbor. It is particularly directed to rolls of web having small central holes which are less susceptible to crushing.

U.S. Pat. No. 4,327,877 describes a continuous winding device for webs of paper, such as toilet paper, comprising a pair of drums drivable at an equal peripheral speed, the first drum having annular seats with perforated zones for suction orifices adapted to exert a suction during the removal of a finished roll and the insertion of a new core. The suction brings the material into the zone in which the tearing is to take place and inserts the material between the drum and the new inserted core.

SUMMARY OF THE INVENTION

It is accordingly an object of this invention to provide a means for minimizing the force that is required to unload a center-unwindable roll of plastic film or plastic tube from a shaft upon which it has been wound.

It is also an object to provide such minimizing of unloading force after exerting a strong gripping force upon the inner surface of the center-unwindable roll during the winding thereof.

It is additionally an object to provide a transfer process that minimizes the exertion of tensional force upon a moving strip or tube of film.

In accordance with these objects and the principles of this invention, a process is herein provided for continuously winding a transversely perforated plastic film on a first bare expandable shaft, which is disposed at a winding position, to form a center-unwindable roll that has an inner diameter of at least about 3 inches, this process comprising the following steps:

A. providing an expanded diameter for the bare expandable shaft that is at least about ¼ inch greater than the relaxed diameter thereof, this expanded diameter being approximately equal to the inner diameter of the center-unwindable roll; and B. providing a selected minimum friction between the outer surface of the bare roll and the plastic film; whereby the wound roll is unloadable from the shaft at the winding position without telescoping thereof. This process further comprises:

A. providing a second bare expandable shaft, having the expanded diameter and the selected minimum friction between its outer surface and the plastic film, and disposing it at a transfer position in the vicinity of the continuously moving film, and B. providing each shaft with a row of openings which are disposed lengthwise of each shaft and are capable of being rapidly connected to a vacuum source.

Each shaft comprises a plurality of arcuate leaves, forming the outer surface of the shaft, which are rigidly supported and radially movable to define the expanded diameter which is preferably about ½ inch greater than the relaxed or contracted diameter. One of the leaves is a vacuum leaf which comprises the row of openings. Preferably, the vacuum leaf comprises a straight pipe in its middle, the openings being selectively spaced along the pipe so that they coincide with the position of a roll to be wound thereon.

More specifically, the process of this invention is directed to continuously winding, on a first bare expandable shaft which is disposed at a winding position, a plurality of transversely perforated and flattened tubes of plastic film to form a plurality of center-unwindable rolls having an inner diameter of at least about 3 inches, the tubes being disposed in parallel, spaced apart, and moving continuously and at a substantially uniform speed from a manufacturing apparatus therefor to form a planar reach which extends toward the winding position, and a second bare shaft being selectively disposed at a transfer position in the vicinity of the reach. Such winding is characterized by the following problems:

(a) the tubes are easily broken at a line of perforation by excessive tension, (b) the resultant tension during the winding is inadequate to compact the rolls tightly, and (c) the wound rolls are easily telescoped during unloading thereof from the first bare shaft.

This invention provides the following steps as an improvement to this winding process:

A. providing an expanded diameter for each bare expandable shaft that is at least about ¼ inch greater than its relaxed diameter, the expanded diameter being approximately equal to the inner diameter of the rolls;

B. providing a selected maximum friction coefficient between the outer surface of each bare roll and the plastic film; and C. providing a row of openings which are disposed lengthwise of each shaft and are capable of being rapidly connected to a vacuum source, whereby:

(1) the winding at a selected tension of the tubes on the first shaft, while it is at the expanded diameter, forms the plurality of rolls, (2) when the rolls being wound on the first shaft are at a selected diameter, the tubes within the planar reach are brought into proximity with the second shaft, (3) while having the expanded diameter, the second shaft is rotated at a peripheral speed equal to the uniform speed, (4) the openings in the second shaft are connected to the vacuum source, (5) the tubes are held by the second shaft along a holding line which is aligned with the openings, the tubes are snapped along a line of perforation that is between the holding line and the first shaft, and the tubes are wound on the second shaft at the transfer position, and (6) the wound rolls on the first shaft are unloaded therefrom without telescoping of the wound rolls.

Preferably, the first and second shafts are cantileverly supported at one end, whereby the wound rolls are axially unloaded toward the unsupported end of the shaft in the winding position.

The vacuum in the vacuum source is suitably about 20 inches Hg and is quickly available when a vacuum reservoir is the vacuum source.

The process of this invention for continuously winding a plurality of transversely perforated and flattened tubes of plastic film to form a plurality of center-unwindable rolls having an inner diameter of at least about 3 inches, the tubes being disposed in parallel, spaced apart, and moving continuously and at a substantially uniform speed from a manufacturing apparatus therefor to form a planar reach which extends towards the winding, may be further defined as comprising:

A. providing at least a first expandable shaft and a second expandable shaft, each shaft having an outer surface which has:

(1) an expanded diameter which is at least about ¼ inch greater than its relaxed diameter, the expanded diameter being approximately equal to the inner diameter of the rolls, (2) a selected maximum friction coefficient toward the plastic film, and (3) a row of openings which are disposed lengthwise of the shaft and are capable of being rapidly connected to a vacuum source; B. disposing:

(1) each shaft transversely to the flattened tubes, (2) the first shaft in a winding position that is farther from the manufacturing apparatus than the second shaft, and (3) the second shaft in a transfer position that is in the vicinity of the planar reach;

C. performing the winding of the tubes on the first shaft, while it is at its expanded diameter, to form the rolls at a selected tension;

D. deflecting the tubes within the planar reach toward the second shaft when the rolls being wound on the first shaft are at a selected diameter;

E. expanding the second shaft to the expanded diameter;

F. rotating the second shaft at a peripheral speed equal to the uniform speed;

G. connecting the openings in the second shaft to the vacuum source;

H. capturing the tubes along a line of capture which is aligned with the openings, snapping the tubes along a line of perforation that is between the line of capture an the first shaft, and continuing to wind the tubes on the second shaft;

I. endwise unloading the wound rolls from the first shaft without telescoping of the wound rolls; and J. moving the second shaft and the rolls being wound thereon into the winding position of the first shaft and moving the first shaft into the transfer position of the second shaft.

A test apparatus is described as a means for defining the maximum acceptable coefficient of friction for rolls of plastic film on a shaft in the winding position. Using the apparatus, marginally acceptable coefficients of friction between the shaft surface and the inside of a fully wound roll were determined to be within the range of 0.61–1.10. Fully acceptable coefficients of friction were determined to be within the range of up to 0.60.

DESCRIPTION OF THE PREFERRED EMBODIMENTS

Figure 1:
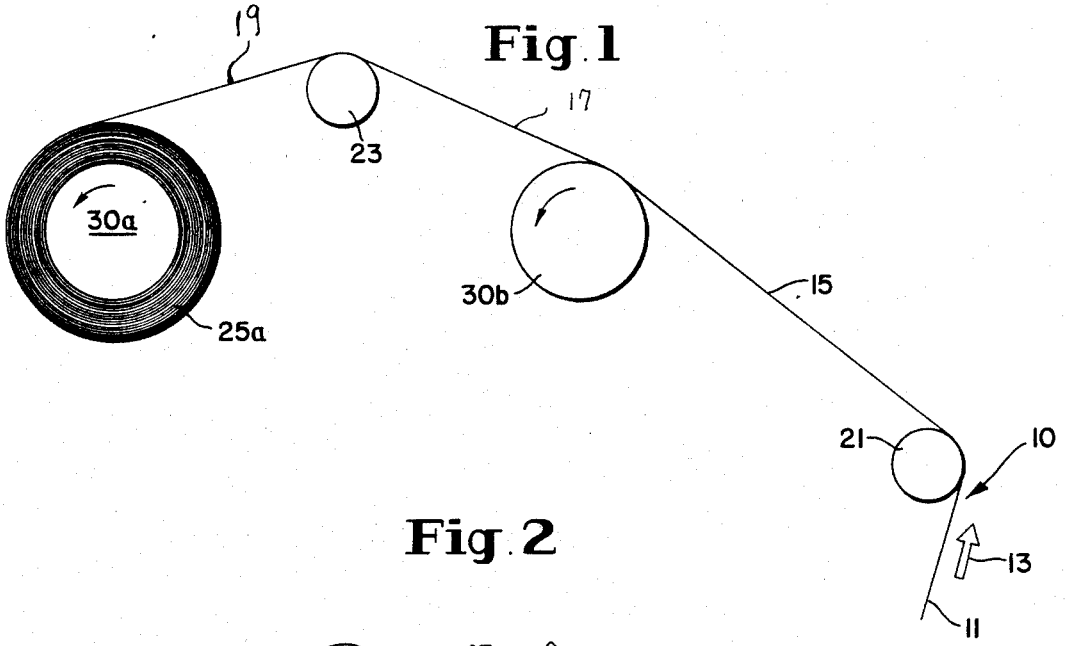
FIG. 1 is a diagrammatic end view of a winding apparatus for large-diameter rolls of plastic film, showing a roll being wound to its full diameter on a bare expandable shaft in the winding position.

As known in the art, film 10 may be wound in either direction and on a wide variety of winding apparatuses. The winding apparatus which is shown in the drawings is intended to be merely illustrative. As shown in the drawings, plastic film 10 is being wound on a bare expandable shaft 30*a* to form a large-diameter roll 25*a* which is usually relatively thin in width. Typically, plastic film 10 has been longitudinally slit to form a plurality of narrow strips which may be wound into an equal plurality of narrow rolls of film, such as tape, for specialty purposes. Even more typically, each of the strips is formed into a tube, gussetted, and transversely perforated and sealed, whereby a consumer can snap off one or more bags from a wound roll as desired for vegetable, freezer, or cold wrapping usages. Because telescoping is particularly bothersome for narrow rolls of film strips and tubes, it should henceforth be understood that references to film should be interpreted as meaning narrow strips of film or tubes, which may or may not be gussetted, having transversely disposed seals and lines of perforations.

Film 10 enters the winding operation as a reach 11 moving upwardly in direction 13 and over idler roll 21, then as reach 15 to a second bare expandable shaft 30*b*, next as reach 17 to idler roll 23, and finally as reach 19 to plastic roll 25*a* on shaft 30*a*. Reaches 15 and 17 may be combined into a single reach, i.e., shaft 30*b* need not be in contact with the film while it is being wound on first expandable shaft 30*a*.

As is well known in the art, when plastic roll 25*a* reaches its full size, a lay-on roll 41 moves downwardly in direction 43 against reach 17 to bend a lay-on reach 45 against surface 39*b* of shaft 30*b*, which is in the transfer position, and a reach 47 which extends to idler roll 23. This movement may be supported by the action of a cut-off knife (not shown in the drawings) moving into air. The film in reach 45 is caught by shaft 30*b* along a line of capture which coincides with fixed vacuum leaf 31*b*. Almost simultaneously, the film is snapped across the tube or tubes of film along a line of perforation which is downstream of shaft 30b, particularly if a cut-off knife is employed.

A new roll 25*b* or a plurality of rolls 25*b* are then built up on second expandable and coreless shaft 30*b* while the wound roll or rolls 25*a* are being unloaded from first expandable shaft 30*a*. Such unloading is possible without telescoping of rolls 25*a* because of the relatively small diameter of contracted shaft 30*a*, as compared to the diameter of inner surface 26*a* of roll 25*a*, and because surface 39*a* of coreless shaft 30*a* is provided with a degree of slipperiness that minimizes sticking of the plastic film to surface 39*a*. A Teflon coating on the outer surfaces of leaves 31, 34 will provide a marginally acceptable surface slipperiness for this purpose. Preferably, this Teflon coating on the outer surface of leaves 31, 34 is a Teflon impregnated Sanford hard lube finish that is 0.0002 inch thick. However, a silicone spray provides an additional coating that further minimizes the coefficient of friction between film 10 and surface 39*a*, creating a fully acceptable winding surface on the shaft.

Figure 4:
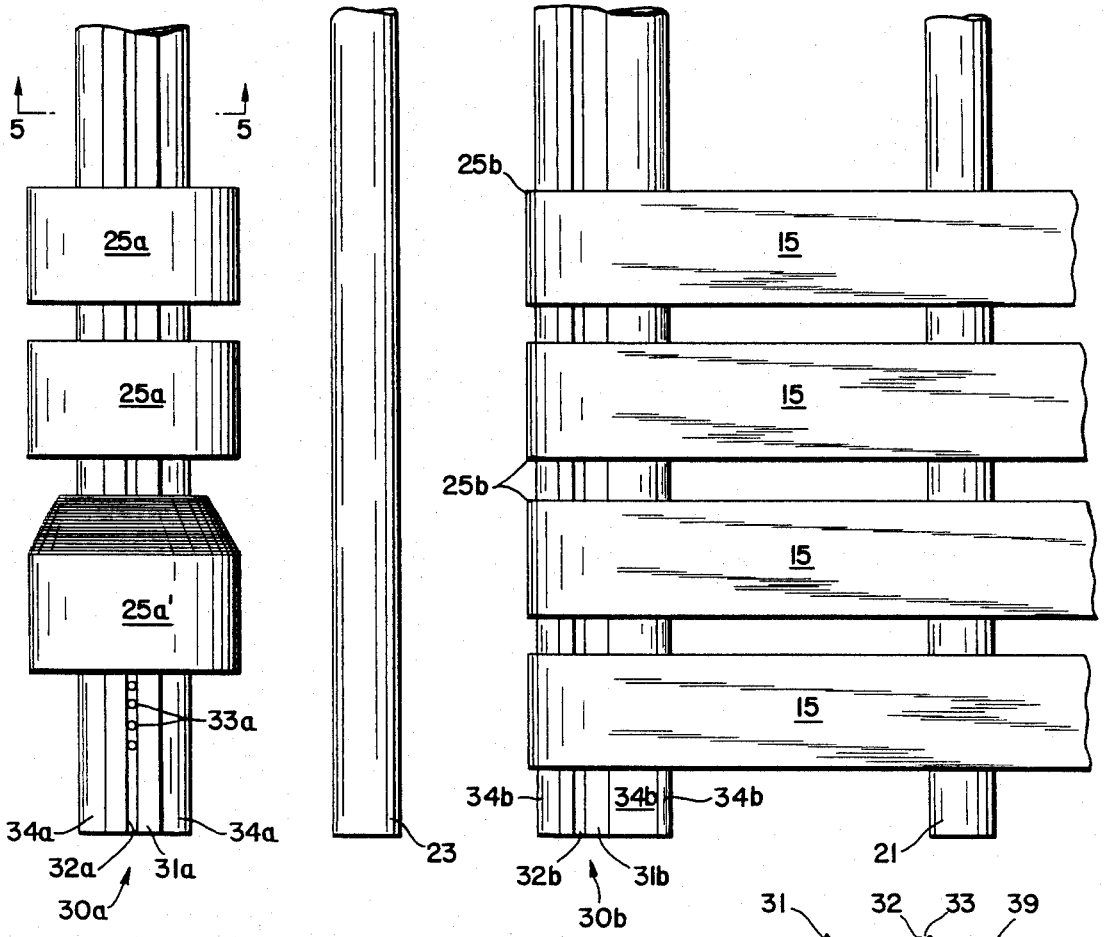
FIG. 4 is a top view of the apparatus shown in FIG. 3, which is winding four lines of plastic film in the form of perforated and sealed tubes, after one roll has been removed from the shaft in the winding position and as a second roll is telescoping while being removed from the shaft.

Telescoping of a roll 25*a*, such as is illustrated by telescoped roll 25*a'* in FIG. 4, must be avoided if at all possible. Center unwindable rolls have a large diameter and are susceptible to telescoping when wound on a coreless shaft. Further, when made of a transversely perforated plastic film, such as a tube to be separated by a customer into bags, the roll cannot be built with sufficient tension to compact it firmly enough for endwise unloading from the shaft without at least a possibility of telescoping. If the coefficient of friction between film 10 and surface 39*a* is too great, such telescoping is difficult to avoid even though the smaller diameter of contracted shaft 30*a*, as compared to conventional construction, provides a relatively small area of contact and permits the operator to minimize sliding contact while removing it from shaft 30*a*.

Leaves 31, 34 have an acceptable winding surface which forms surface 39 of roll 30. This surface has a desired maximum coefficient of friction toward film 10 that is provided by a Teflon impregnated Sanford hard lube finish which is 0.0002 inch thick and is preferably aided by periodic spraying with a silicone lubricant.

As is known in the art, a layer of outwardly moving air can also be employed to reduce friction when axially unloading wound rolls 25*a* form shaft 30*a*. However, this procedure is not ideal for handling narrow, spaced-apart rolls 25*a*, as illustrated in FIG. 4. Providing leaves 31, 34 with a grooved surface, thereby reducing the area of possible frictional contact between surfaces 26*a*, 39*a*, is consequently preferred over the moving air method as an alternative means for reducing friction when unloading wound rolls 25*a*.

Vacuum leaf 31 comprises a central tube or pipe 32, having a plurality of holes 33 which are spaced along pipe 32 according to the width and spacing apart of the plastic rolls 25 to be wound on a shaft 30. When plastic rolls having a different width are to be wound, each shaft 30*a*, 30*b* is preferably replaced by another pair of shafts, each comprising a vacuum leaf 31 having a different spacing of holes 33.

Figure 5:
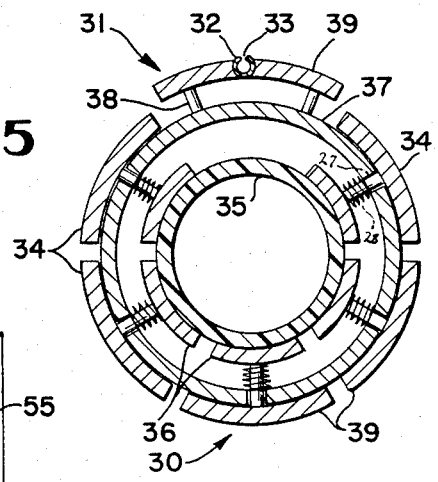
FIG. 5 is a sectional view of an expandable vacuum shaft, looking in the direction of the arrows 5–5 in FIG. 4.

The relaxed state of air bladder 35, as seen in FIG. 5, allows movable leaves 34 to retract onto shaft body 37 as compression springs 28, surrounding the buttons 27 attached to each movable leaf 34, urge pressures flanges 36 to remain in contact with air bladder 35 which is made of tear-resistant neoprene with bonded ends. Relaxation of air bladder 35 allows a full ¼ inch (preferably up to about ½ inch) of diameter to be available between surfaces 39*a* and 26*a* for removing the wound rolls 25*a* of film without telescoping thereof.

Figure 2:
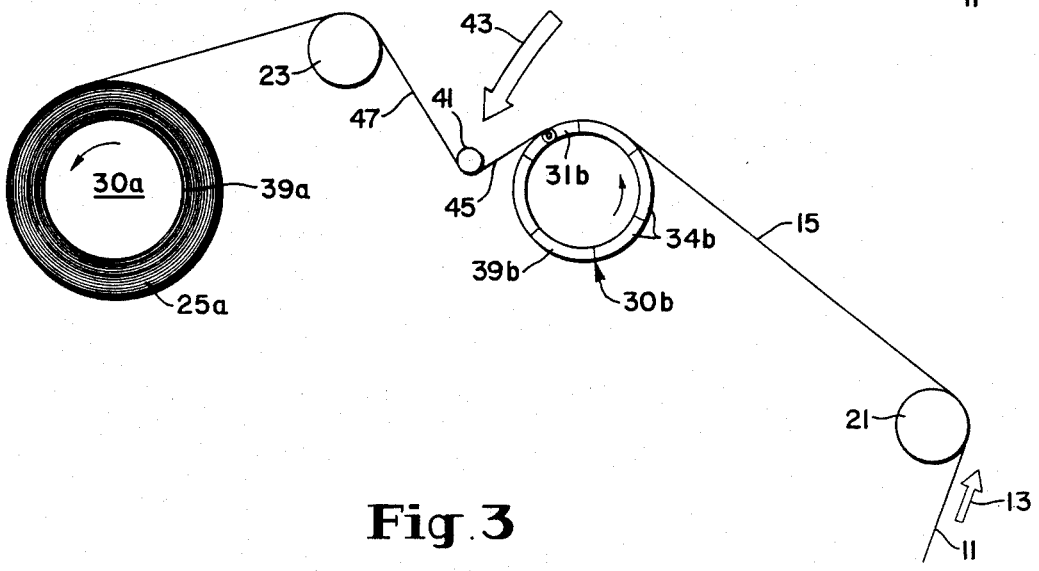
FIG. 2 is a similar view of the same apparatus and roll shown in FIG. 1 while transfer of the moving film to a roll in the transfer position is being initiated.
Figure 3:
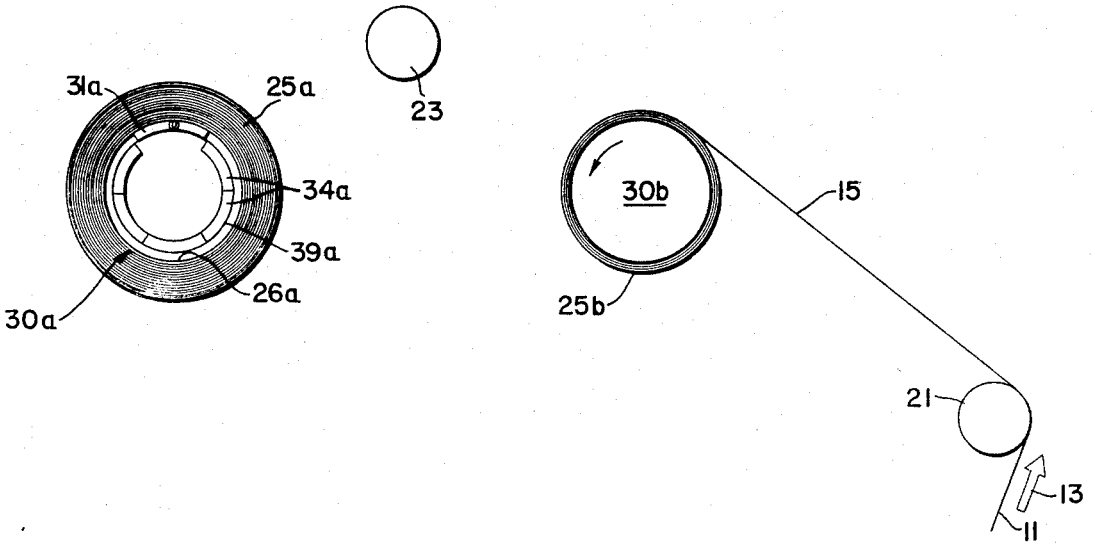
FIG. 3 shows the same apparatus while the new roll is being wound on the shaft at the transfer position and as the wound roll is being removed from the shaft at the winding position.

When leaves 34 are fully expanded to the radius of fixed vacuum leaf 31, as when a roll 30*b* is at the transfer position, as seen in FIG. 2, holes 33 provide a suction force which grabs lay-on reach 45 of each tube of plastic film 10 and holds it firmly for wrapping about surface 39*b* of the roll. Because pipe 32 is small in diameter and at least about 20 inches Hg of vacuum is quickly available from a reservoir thereof, the vacuum is very quickly applied and concentrated at holes 33*b*.

However, vacuum can be provided for shaft 30 by other devices, such as a fixed hollow arcuate leaf of approximately trapezoidal shape, having selectively spaced openings therein. A plurality of side-by-side tubes, having a diameter equal to the distance from the surface of shaft body 37 to the expanded surface of a shaft 30, can also be attached to each other and to shaft body 37 to simulate a vacuum leaf 31, one or more of the tubes being perforated and connected to a vacuum source.

Bare expandable shafts 30*a*, 30*b* are exactly the same in design and are shown in section in FIG. 5 as shaft 30 having a single fixed vacuum leaf 31, a plurality of movable leaves 34, a button assembly 36 for each of the movable leaves 34, an intermediate tubular shaft body 37 having apertures therein, columns 38 which rigidly support vacuum leaf 31 and are attached to shaft body 37, and an elongated central air bladder 35 which is disposed axially within shaft body 37. Each button assembly 36 comprises an elongated pressure flange which has the same curvature as the expanded bladder, a row of buttons or studs which slide within the apertures in shaft body 37 and are rigidly attached to the flange and to a leaf 34, and a compression spring which surrounds each of the buttons. Shaft 30, except for vacuum leaf 31, is commercially available from Nim-Cor Inc., 575 Amherst Street, Box K, Nashua, N.H. 03061.

Figure 6:
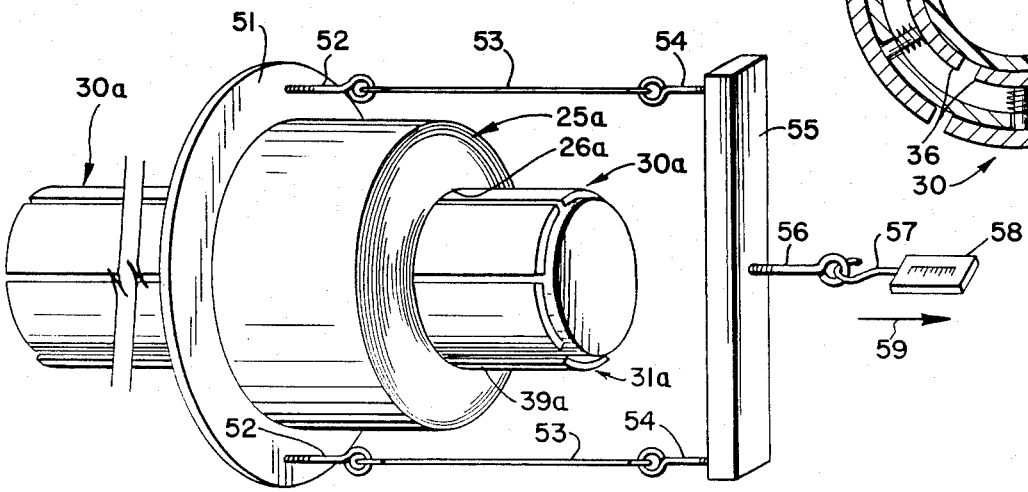
FIG. 6 is a perspective view of a test apparatus for determining the frictional characteristics of a winding shaft in its contracted state with respect to a wound roll of plastic film.

A frictional test apparatus 50 is shown in FIG. 6. This apparatus is suitable for determining the frictional forces generated by removing a wound roll 25*a* from a shaft 30*a* in the winding position. Apparatus 50 comprises a plywood stripper plate 51 having a central hole therein, a pair of eye screws 52 which are attached to one side of plate 51 and on opposite sides of the central hole, a pair of cables 53 which are attached to eye screws 52, a pair of eye screws 54 which are attached to cables 53, an equalizing harness 55 to which eye screws 54 are attached on one side thereof, an eye screw 56 which is attached to the center of the other side of harness 55, a hook 57 which is connected to the eye of eye screw 56, and a strain gage 58 which is attached to hook 57.

To conduct frictional tests with assembled apparatus 50, stripper plate 51 is inserted over the end of a cantilevered shaft 30*a*, and a fully wound roll 25*a* of plastic film is next inserted onto shaft 30*a* and pressed snugly against plate 51. Harness 55 is held so that cables 53 are substantially parallel to surface 39*a*, and pull 59 is exerted with sufficient force to provide a firm, smooth motion at about one inch per second. The peak break away or static load and the sliding (dynamic) load are recorded. The dynamic load is divided by the weight of the tested roll 25*a*, both being in the same weight units, to produce a dimensionless coefficient of friction.

Tests for winding surface acceptability were made in this manner by using apparatus 50 on identical bare aluminum shafts 30a having an outside diameter of six inches and the three following surface conditions for surface 39*a*:

(1) no surface treatment;

(2) a Teflon impregnated Sanford hard lube finish; and (3) a silicone spray coating on the hard lube finish.

A fully wound roll 25*a* of 1,000 plastic bags, weighing 5.85 pounds, (specification weight), having an outside diameter of 10 inches, and made of plastic film containing about 2,000 ppm of a euricimide slip agent, was used for each test.

Static load values were difficult to read but did not differ greatly from dynamic load values. The two load values were consequently assumed to be essentially the same, and only dynamic load values were recorded while maintaining a steady pull of about one inch per second for these three conditions. The position of vacuum leaf 31 was determined to be immaterial. The value for each condition was the average of five tests, 95% confidence limits being about 0.5 lb. The coefficient of friction was then calculated as the ratio of the pulling force to the weight of the load, i.e., roll 25*a*.

The load value, the acceptability, and the coefficient of friction for each condition were as follows:

| Load value, lbs | Acceptability | Coefficient of Friction |
|---|---|---|
| (1) 9.5 | not acceptable | 1.62 |
| (2) 6.25 | marginally acceptable | 1.07 |
| (3) 3.5 | fully acceptable | 0.60 |

Generally, the frictional coefficient range for marginal acceptability was 0.61–1.10, and the range for full acceptability was 0–0.60.

While the foregoing embodiments are preferred, it is to be understood that numerous modifications and variations may be made therein by those skilled in the art, and it is intended to cover in the appended claims all such modifications and variations as fall within the principles and scope of the invention.

What is claimed is:

1. A bare expandable winding shaft for winding transversely perforated plastic film to form a plurality of center-unwindable rolls at a plurality of winding positions, said shaft comprising:

A. a plurality of elongated leaves forming a generally cylindrical outer surface upon which said rolls are wound;

B. an intermediate tubular shaft body having apertures for radially movable buttons;

C. an elongated central air bladder which is arranged axially within said shaft body, said bladder being adapted to move said buttons radially for changing the effective diameter of said outer surface through an expansion range of at least about 0.25 inch between an expanded diameter and a relaxed diameter, said expanded diameter being at least about 3 inches;

D. a vacuum leaf which replaces one of said movable leaves at said expanded diameter and is immovably supported in fixed radial position on said tubular shaft body;

E. a plurality of roll winding locations that are spaced axially apart along said shaft, each said roll location having an axially grouped plurality of holes in said vacuum leaf for contacting said plastic film when said rolls are being wound on said shaft at said expanded diameter;

F. a vacuum means which is:

(1) aligned with the axis of said expandable shaft, (2) capable of being rapidly connected to a high-capacity vacuum source, and (3) in fluid communication with said holes in said outer surface of said vacuum leaf; and G. a friction-reducing means on said outer surface for imparting a selected maximum coefficient of friction between said outer surface and said plastic film.

2. The winding shaft of claim 1, wherein said vacuum source contains a vacuum of at least about 20 inches Hg.

3. The winding shaft of claim 1, wherein said coefficient of friction is up to about 1.10.

4. The winding shaft of claim 3, wherein said coefficient of friction is up to about 0.60.

5. The winding shaft of claim 4, wherein said friction-reducing means is a Teflon coating on said outer surface and a silicone spray coating over said Teflon coating.

6. The winding shaft of claim 5, wherein said Teflon coating is a Teflon impregnated Sanford hard lube finish that is about 0.0002 inch thick.

7. The winding shaft of claim 3, wherein said friction-reducing means is a Teflon coating on said surfaces of said fixed vacuum leaf and said plurality of movable leaves.

8. The winding shaft of claim 7, wherein said Teflon coating is a Teflon impregnated Sanford hard lube finish that is about 0.0002 inch thick.

9. The winding shaft of claim 7, wherein said buttons move said radially movable leaf members through a distance of at least about ½ inch.

* * * * *